US005105483A

United States Patent [19]

Levien

[11] Patent Number: 5,105,483

[45] Date of Patent: Apr. 21, 1992

[54] TWIST GRAB BAR

[75] Inventor: Robin H. Levien, London, England

[73] Assignee: American Standard Inc., New York, N.Y.

[21] Appl. No.: 598,910

[22] Filed: Oct. 16, 1990

[51] Int. Cl.[5] ..... A47K 3/12

[52] U.S. Cl. ..... 4/577.1

[58] Field of Search ..... 4/577, 576, 611, 573; 16/111 R, 125, 110 R, DIG. 19, DIG. 12

[56] References Cited

U.S. PATENT DOCUMENTS

| | | | |
|---|---|---|---|
| 2,005,576 | 6/1935 | Buhl et al. | 4/577 |
| 2,066,088 | 12/1936 | Bentley | 4/577 |
| 2,642,581 | 6/1953 | Loe | 4/577 |
| 3,016,547 | 1/1962 | Flood | 4/577 |
| 3,894,300 | 7/1975 | Shively | 4/577 |
| 3,968,524 | 7/1976 | Zentman | 4/577 |
| 4,417,736 | 11/1983 | Smith | 4/577 |
| 4,887,323 | 12/1989 | DiVito et al. | 4/577 |
| 4,964,192 | 10/1990 | Marui | 16/111 R |
| 4,969,231 | 11/1990 | Mader et al. | 16/111 R |

FOREIGN PATENT DOCUMENTS

| | | | |
|---|---|---|---|
| 0587988 | 8/1935 | Fed. Rep. of Germany | 4/577 |
| 1800532 | 7/1970 | Fed. Rep. of Germany | 4/567 |
| 2320622 | 11/1974 | Fed. Rep. of Germany | 4/577 |
| 02259575 | 8/1975 | France | 4/577 |
| 0357167 | 11/1961 | Switzerland | 16/125 |
| 0559031 | 2/1975 | Switzerland | 4/577 |

*Primary Examiner*—William A. Cuchlinski, Jr.
*Assistant Examiner*—John L. Beres
*Attorney, Agent, or Firm*—J. P. Sinnott

[57] ABSTRACT

The present invention provides a grab bar for bathing vessels. The grab bar has a substantially sinusoidal shape in the horizontal (X) and vertical (Y) coordinates, and is twisted approximately 90° in the (Z) coordinate. In a preferred embodiment, the grab bar is mounted at one end to the deck of the bathing vessel, and the other end which is oriented at approximately a 90° angle is mounted to the interior vertical wall of the bathing vessel. In alternate embodiment, the grab bar may be mounted on any two walls which are substantially perpendicular to each other on the bathing vessel to provide a range of angles at which the bather may hold onto and support himself relative to the walls of the bathing vessel and the grab bar.

5 Claims, 4 Drawing Sheets

FIG. 6
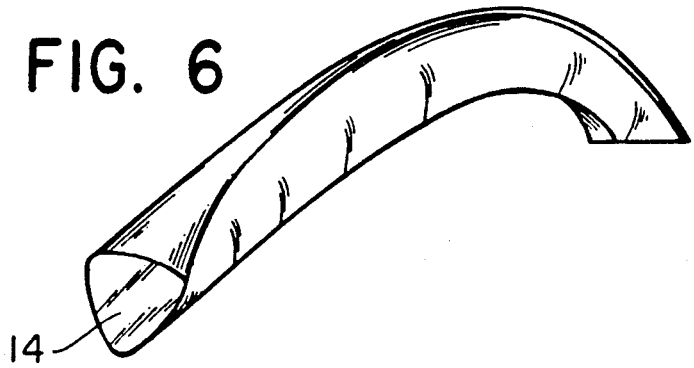
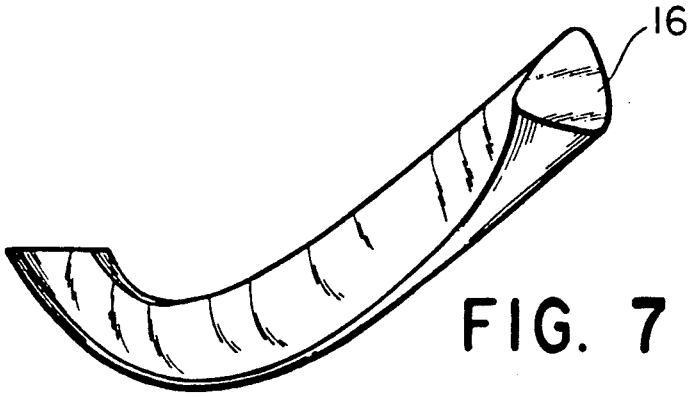
FIG. 7
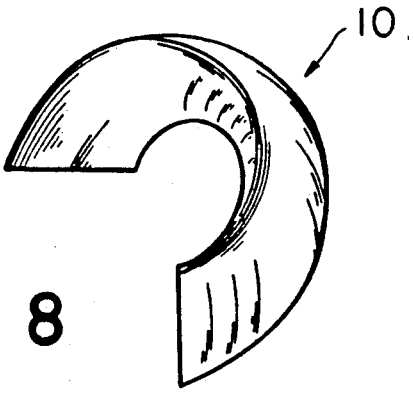
FIG. 8
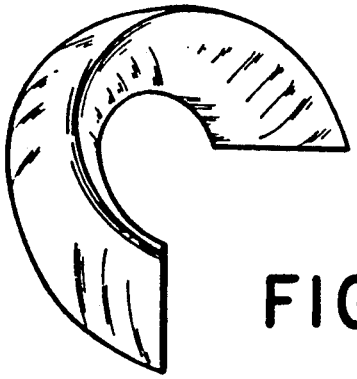
FIG. 9

TWIST GRAB BAR

BACKGROUND OF THE INVENTION

1. Field of Invention

This invention pertains to a grab bar for bathing vessels such as bathtubs, spas, whirlpool tubs, swimming pools and the like.

2. Background of the Related Art

Tub grab bars have been used in association with whirlpool tubs, spas and swimming pools to assist bathers in entering and leaving the bathing vessel. Numerous shapes and embodiments have been used, for example those described in U.S. Pat. No. 2,242,461 showing a grab bar on the far side wall of a bathtub having a sideways H shape. Another common grab bar for bathtubs is described in U.S. Pat. No. 4,316,294. The bar extends from the floor upwards parallel to the apron of the tub and loops downwards where it contacts the tub's deck.

Various other embodiments for removable grab bars have been described for assisting the elderly and infirm to enter and leave bathing vessels. Most of these have a bar which either lies perpendicular to the plane of the tub's deck as in U.S. Pat. No. 4,316,294 or parallel to the plane of the deck.

The prior grab bar embodiments are useful for assisting the bather to enter or leave the bathtub at one stage, i.e. when traversing the apron and deck, or to hold onto the bathtub while in a standing position, as described in U.S. Pat. No. 2,242,461. None of the related art, however, shows a grab bar which assists the bather not only in traversing the surface of the deck of the tub, but also in assisting to lower and lift the bather from a standing to a sitting position. Additionally, none of the related art provides such a grab bar in an aesthetically pleasing, safe and unobtrusive configuration.

Accordingly, it is a feature of the present invention to provide a grab bar which will assist the bather in entering and leaving a bathing vessel such as a bathtub, whirlpool tub, spa or swimming pool during the entire range of movement from a standing to a sitting or lying position, and in raising the bather from the lying or sitting position, and in traversing and leaving the bathing vessel.

SUMMARY OF THE INVENTION

These and other features are provided by the present invention which describes a grab bar for bathing vessels. The grab bar has a substantially sinusoidal shape in the horizontal (X) and vertical (Y) coordinates, and is twisted approximately 90° in the (Z) coordinate. The sinsusoidal-shaped grab has an upper curved surface and a lower curved surface. The upper-curved surface is equal to the inverse of the lower-curved surface of the grab bar before the grab bar is twisted. In a preferred embodiment, the grab bar is mounted at one end to the deck of the bathing vessel, and the other end which is oriented at approximately a 90° angle is mounted to the interior vertical wall of the bathing vessel. In alternate embodiment, the grab bar may be mounted on any two walls which are substantially perpendicular to each other on the bathing vessel to provide a range of angles at which the bather may may hold onto and support himself relative to the walls of the bathing vessel and the grab bar.

For a better understanding of the present invention, reference is made to the following description, taken in conjunction with the accompanying figures, the scope of which is pointed out in the appended claims.

BRIEF DESCRIPTION OF THE DRAWINGS

FIG. 6 is a bottom plan view thereof, viewed in the direction of the arrow (6) in FIG. 4.

FIG. 7 is a rear elevational view thereof, viewed in the direction of the arrow (7) in FIG. 5.

FIG. 8 is a left side elevational view thereof, viewed in the direction of the arrow (8) in FIG. 4.

FIG. 9 is a right side elevational view thereof, viewed in the direction of the arrow (9) in FIG. 4.

DETAILED DESCRIPTION OF THE INVENTION

Figure 3:
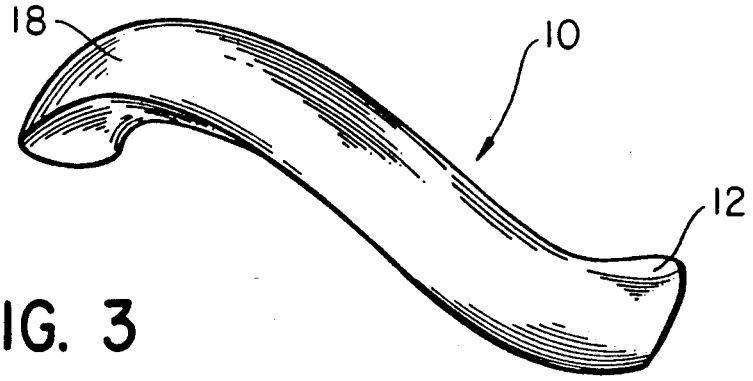
FIG. 3 is a perspective view of the twist grab bar of the present invention.
Figure 4:
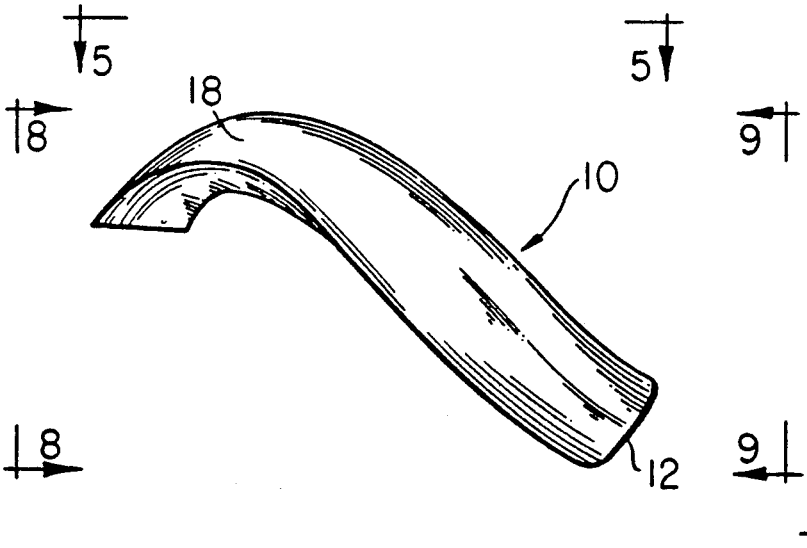
FIG. 4 is a front elevational view thereof.
Figure 5:
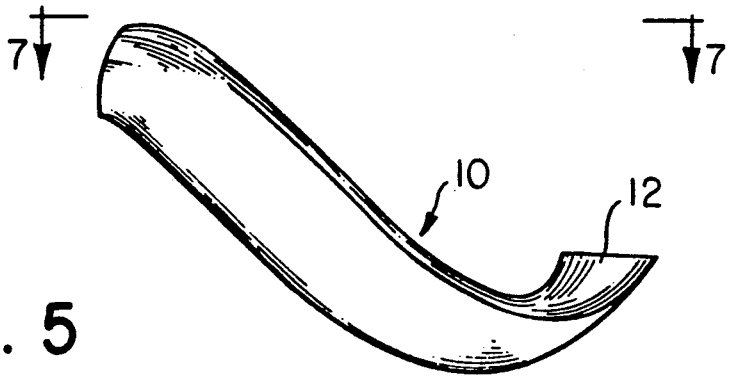
FIG. 5 is a top plan view thereof, viewed in the direction of the arrow (5) of FIG. 4.

The present invention is a grab bar 10 for bathtubs, whirlpool tubs, spas, swimming pools and other bathing vessels 100. The grab bar 10 of the present invention has a substantially sinusoidal shape as shown in FIG. 3 in the X and Y coordinates with the bottom 12 of the grab bar twisted in the Z coordinate, preferably at an angle of approximately 90°. The twist permits the grab bar to be mounted onto substantially perpendicular surfaces such as the deck 50 and interior side wall 55 of a bathtub, whirlpool tub and other bathing vessels 100.

The end cross sections 14, 16 of the grab bar 10 of the present invention are shown in FIGS. 6 and 7, preferably a rounded equilateral triangle. Any shape which can be easily gripped such as an ellipse, rounded rectangle, circle, or other polygonal shapes may also be suitable for use in the present invention as a cross sectional shape. Additionally, it is contemplated that the cross sectional shape of the present invention may change from one end 14 of the grab bar to another 16.

Although the grab bar 10 of the present invention is contemplated for mounting on the deck and inner wall of the bathing vessel, other useful positions for the grab bar are also contemplated, such as on any two substantially perpendicular walls of a swimming pool spa, hot tub, or shower to permit the user a plurality of positions or angles for the user to hold the grab bar. The grab bar may be used on one, two or more sides of the bathing vessel to permit use of both hands to support an individual in a bathing vessel or to accommodate more than one user.

The grab bar of the present invention is preferably constructed from a polymeric injection molded plastic material. Preferably, the grab bar of the present invention is made using gas injection molding to provide an elongated twisted sinusoidal shape in which the core is hollow. This type of construction provides a lightweight part with relatively fast cycle time, due to the faster curing of the reduced cross sectional area. Alternatively, the grab bar may be formed using a rotational molding process, reaction injection molding (RIM) or other suitable molding and extrusion processes.

The grab bar may also be made from metal, glass, porcelain or other suitable materials. The grab bar is preferably mounted on the deck and inside wall of the tub's surface through the use of blind bolts and/or adhesives.

Figure 1:
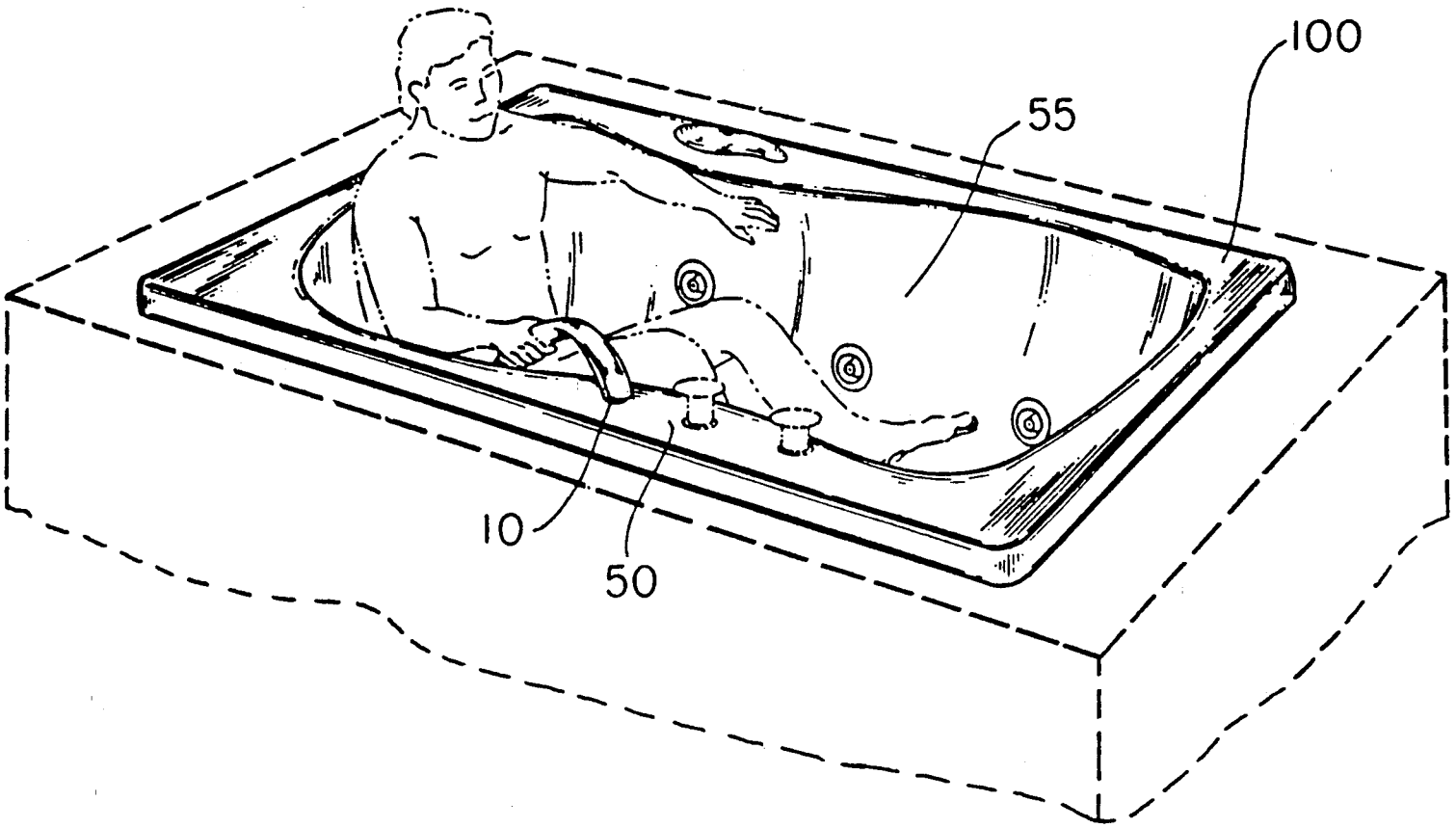
FIG. 1 illustrates a preferred embodiment of the present invention mounted on a whirlpool tub with the user reclined within the tub.
Figure 2:
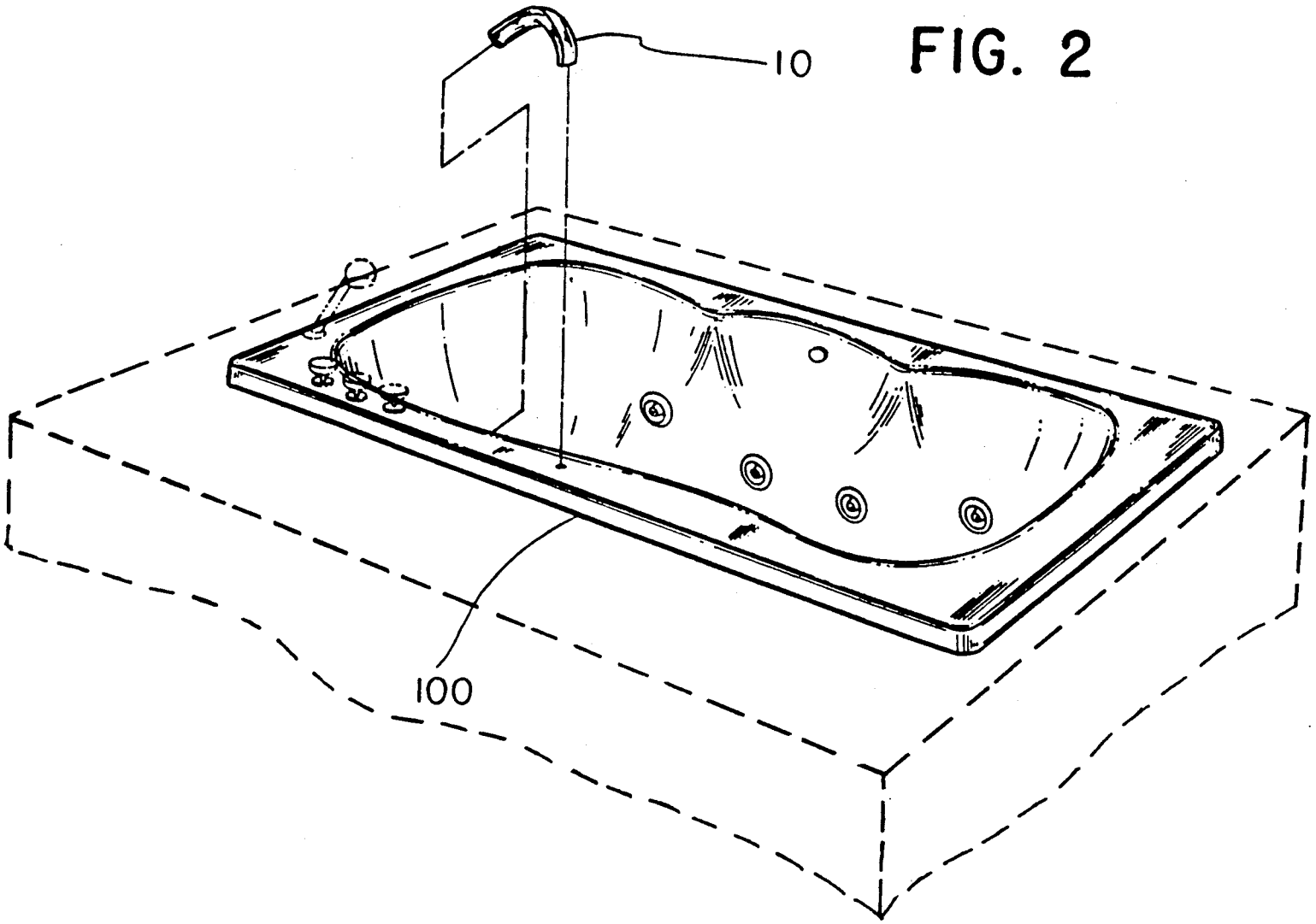
FIG. 2 is an exploded view thereof, with the bather and some of the accessories removed.

When in use, as illustrated in FIG. 1 the user can hold the side or upper surface of the grab bar while traversing the deck and apron area of the tub. The user can then turn around inside the tub while still maintaining a grip on the upper surface of the grab bar. The grab bar can also be held to assist and the hand of the user to rotatively slide down the bar towards the vertical side wall 55 of the vessel. In this manner the grab bar can assist the user during the entire transition from a standing to a sitting or reclined position within the bathing vessel. Then, when leaving the bathing vessel or to assist the user in standing up, the one or two grab bars may be pulled by their lower surface 12 to lift the user while moving from a sitting or reclining position to a standing position. The upper surface 18 of the grab bar can then be held in assisting the bather to traverse the deck 50 and/or apron of the tub while leaving the tub 100. The smooth rounded sinusoidal shape of the grab bar does not present any sharp edges to the user, while offering a highly useful and pleasing form which is functionally superior the grab bars of the prior art. In an alternative embodiment, the grab bar may be temporarily mounted and removed using a bayonet or other interlocking or fitting means.

Thus, while there have been described what are the presently contemplated preferred embodiments of the present invention, further changes and modification could be made by those skilled in the art without departing from the scope of the invention, and it is contemplated to claim all such changes and modifications.

I claim:

1. A grab bar comprising an elongated smooth, rounded sinsusoidal-like shape in the X and Y coordinates and twisted approximately 90° in the Z coordinate, said grab bar having an upper surface and a lower surface, said upper surface being equal to the inverse of said lower surface before said bar is twisted.

2. The grab bar recited in claim 1, which has a substantially rounded-triangular lateral cross-sectional shape.

3. The grab bar recited in claim 1, which has a lateral cross-sectional shape selected from the group consisting of circle, ellipse, triangle, polygon, rounded polygon and a combination thereof.

4. The grab bar recited in claim 1, which has a substantially hollow core.

5. The grab recited in claim 1, which is molded from a polymeric material.

* * * * *